US006846573B2

(12) United States Patent
Seydel

(10) Patent No.: US 6,846,573 B2
(45) Date of Patent: Jan. 25, 2005

(54) MOISTURE RESISTANT, REPULPABLE PAPER PRODUCTS AND METHOD OF MAKING SAME

(75) Inventor: Scott O. Seydel, Atlanta, GA (US)

(73) Assignee: EvCo Research LLC

( * ) Notice: Subject to any disclaimer, the term of this patent is extended or adjusted under 35 U.S.C. 154(b) by 10 days.

(21) Appl. No.: 10/409,238

(22) Filed: Apr. 8, 2003

(65) Prior Publication Data

US 2003/0198826 A1 Oct. 23, 2003

Related U.S. Application Data

(60) Provisional application No. 60/373,952, filed on Apr. 19, 2002.

(51) Int. Cl.[7] ..... B32B 29/00

(52) U.S. Cl. ..... 428/537.5; 428/536; 428/34.2

(58) Field of Search ..... 428/537.5, 536, 428/34.2

(56) References Cited

U.S. PATENT DOCUMENTS

| | | | | |
|---|---|---|---|---|
| 2,691,606 A | | 10/1954 | Ziiiox et al. | |
| 3,066,039 A | | 11/1962 | Francisco de Tienda y Ricon et al. | |
| 3,108,889 A | | 10/1963 | Miranda | |
| RE29,272 E | | 6/1977 | Hintz | |
| 4,154,899 A | | 5/1979 | Hershey et al. | |
| 4,253,840 A | | 3/1981 | Illman | |
| 4,260,643 A | | 4/1981 | Cochran | |
| 4,263,216 A | | 4/1981 | Volpenhein | |
| 4,348,460 A | | 9/1982 | Saunders et al. | |
| 4,350,737 A | | 9/1982 | Saunders et al. | |
| 4,385,436 A | | 5/1983 | Saunders et al. | |
| 4,385,437 A | | 5/1983 | Saunders et al. | |
| 4,390,590 A | | 6/1983 | Saunders et al. | |
| 4,401,782 A | | 8/1983 | Conklin | |
| 4,406,055 A | | 9/1983 | Saunders et al. | |
| 4,410,592 A | | 10/1983 | Saunders et al. | |
| 4,449,290 A | | 5/1984 | Saunders et al. | |
| 4,676,836 A | | 6/1987 | Hill et al. | |
| 4,690,834 A | | 9/1987 | Appelgren et al. | |
| 4,753,743 A | | 6/1988 | Sech | |
| 4,767,669 A | | 8/1988 | Conklin | |
| 4,853,038 A | | 8/1989 | Leithaeuser et al. | |
| 5,069,806 A | | 12/1991 | Trivett | |
| 5,089,157 A | | 2/1992 | Trivett | |
| 5,229,023 A | | 7/1993 | Landis | |
| 5,491,190 A | | 2/1996 | Sandvick | |
| 5,587,202 A | | 12/1996 | Sandvick et al. | |
| 5,665,426 A | | 9/1997 | Krzysik et al. | |
| 5,670,463 A | | 9/1997 | Maples | |
| 5,700,516 A | | 12/1997 | Sandvick et al. | |
| 5,879,512 A | | 3/1999 | McGerrity et al. | |
| 5,880,064 A | | 3/1999 | Kagota et al. | |
| 5,990,055 A | | 11/1999 | Garmier | |
| 6,103,308 A | * | 8/2000 | Floyd et al. | 427/363 |
| 6,143,113 A | | 11/2000 | Berube | |
| 6,162,771 A | | 12/2000 | Floyd et al. | |
| 6,201,053 B1 | * | 3/2001 | Dieckmann et al. | 524/301 |
| 6,255,375 B1 | | 7/2001 | Michelman | |
| 6,419,791 B1 | | 7/2002 | Dragner | |
| 6,541,556 B1 | | 4/2003 | Berube | |

* cited by examiner

*Primary Examiner*—Leszek Kiliman
(74) *Attorney, Agent, or Firm*—McNair Law Firm, P.A.; William D. Lee, Jr.

(57) ABSTRACT

Hydrogenated triglycerides having melting points above 50° C. are substituted for paraffin as a coating material for the surface of paper products and the resulting paper products have improved wet strength and moisture resistance in addition to being repulpable thereby providing a distinct environmental advantage over paraffin coated products.

9 Claims, 2 Drawing Sheets

MOISTURE RESISTANT, REPULPABLE PAPER PRODUCTS AND METHOD OF MAKING SAME

CROSS REFERENCE TO RELATED APPLICATION

This application claims priority from provisional application Ser. No. 60/373,952 filed Apr. 19, 2002, having the same title and inventor.

FIELD OF THE INVENTION

This invention relates to moisture resistant and water proof paper products including linerboard and corrugated board. Particularly, this invention relates to moisture resistant paper products that can be repulped and recycled to be part of the feedstock for new paper products. Even more particularly, this invention relates to the use of a moisture-proofing, treating material that minimizes environmental concerns.

BACKGROUND OF THE INVENTION

In the manufacture of paper and paperboard, and of products made from paper and paperboard, petroleum derived paraffin waxes and synthetic polymers have been used for many years as moisture retardants, water repellents, oil repellents, stiffeners, strengtheners, and release agents. Besides paraffin, material used most often is probably polyethylene, but other widely used polymers include polymerized acrylics, vinyls, styrenes, ethylenes and copolymers or hetero-polymers of these monomers. The paper and paperboard to which these traditional materials are applied becomes difficult and often impossible to repulp and recycle in standard paper mill processes because the petroleum derived polymers and, particularly, the petroleum waxes are non-biodegradable in mill white waters (circulated process waters) and discharge effluents, and the residue of the petroleum waxes that is not removed from pulp fibers during the repulping and recycling processes cause severe problems due to buildup that occurs on the screens and felts used during the process of forming and making the paper or paperboard sheet. In addition, paper and paperboard coated or impregnated with petroleum waxes resist biodegradation and composting when disposed of in landfills and other waste disposal systems. Paper and paperboard coated or impregnated with traditional synthetic polymers and hetero-polymers are also difficult and often impossible to repulp and recycle owing to their resistance to separation from the fiber in the standard repulping processes resulting in significant fiber losses in efforts to repulp and recycle them, and these are also non-biodegradable and therefore resist composting.

Accordingly, it is one object of the present invention to provide a method of waterproofing a paper product that will allow the product to be readily repulped and recycled after use.

In the past, vegetable oil triglycerides have been used as coating lubricants for paper coatings in starch-based emulsions as described in U.S. Pat. No. 6,201,053 and in U.S. Pat. No. 6,103,308. While such emulsion coatings may provide some degree of water resistance, it is an object of the present invention to provide improved waterproofing and wet strength that does not require starch or an aqueous solution for application.

In another prior art patent, namely, U.S. Pat. No. 6,201,053 the use of a partially saponified triglyceride (PST) is disclosed where the PST may be a thickening agent, surfactant, water proofing agent, or coupling where PST consists of a homogeneous mixture of a metal salt, a fatty acid of said triglyceride, and a mixture of monoglyceride, diglyceride and triglyceride in the absence of a compatibilizing agent. These PST's are said to be useful as lubricants for paper surfaces and can act as water repellants but this process is one of saponification and not hydrogenation. Accordingly, it is another object of the present invention to provide an environmentally compatible alternative to paraffin wax and other coatings by employing hydrogenated triglycerides.

The foregoing and other objects are achieved by the present invention which is described below in the Summary of the Invention and Detailed Description.

SUMMARY OF THE INVENTION

In one aspect the present invention is the surprising discovery that hydrogenated vegetable oil or lard or tallow triglycerides can be applied in the same manner as the traditional petroleum waxes and synthetic polymers and function as moisture retardants, water repellents, oil repellents, stiffeners, strengtheners, and release agents in the manufacture of paper, paperboard, packaging, molding forms, and other common applications. A particular advantage is that products of this invention are readily biodegradable in paper mill white waters and are compostable in landfill or other waste disposal systems. They are far more dispersible than the traditional products and thus are easier to repulp and recycle without detriment to production equipment, processes, or manufactured product quality or performance.

In another aspect, the present invention is a repulpable, moisture resistant paper product comprising a paper substrate with a hydrogenated triglyceride coating on at least one surface that has been applied as a hot melt. The hydrogenated triglyceride product tends to penetrate the paper to a greater depth and adhere to fibers to a greater extent than does paraffin wax.

In still another aspect the present invention is a treated paper product and method of treating a paper product to make the product water resistant by applying a hot melt, hydrogenated triglyceride to a surface of the paper by spraying, rolling, or dipping the paper product. Said hot melt triglyceride preferably has a melting point in the range of about 55° (131° F.) to about 65° C. (148° F.) and is derived from edible grade vegetable or animal products. It is preferred that the melting point be at least about 50° C. In some embodiments it has been found to be advantageous to add fumed silica and vegetable oil to hot melt triglycerides to improve gluing, printability, and appearance.

In a further aspect, the present invention is a method of treating a paper product to make it water resistant and repulpable by applying a hot melt hydrogenated triglyceride to the surface of the paper.

In yet another aspect, the invention is the process of waterproofing or moisture proofing substrates and surfaces that are either woven or non-woven cellulosic materials or compise a water absorbent material, said process having the step of coating said surface or substrate with a hydrogentated triglyceride having a minimum melting temperature of about 50° C. Specifically, the invention contemplates hydrogenated triglyceride coatings for any water absorbent material or surface.

In another aspect the especially useful triglyceride used in this invention can be characterized as a blend of triglycerides with carbon chain lengths of between C:14 and C:20 saturated and unsaturated. These triglycerides are then further processed to give desirable melting point ranges and rheological characteristics. The blends of natural, partially, and fully hydrogenated triglycerides are formulated to give amorphic crystalline structures that make suitable coatings for the paper industry.

DESCRIPTION OF THE DRAWINGS

The invention will be more readily understood from a reading of the following specification and by reference to the accompanying drawings which form a part of the specification and illustrate one embodiment thereof.

DEFINITION

Figure 1:
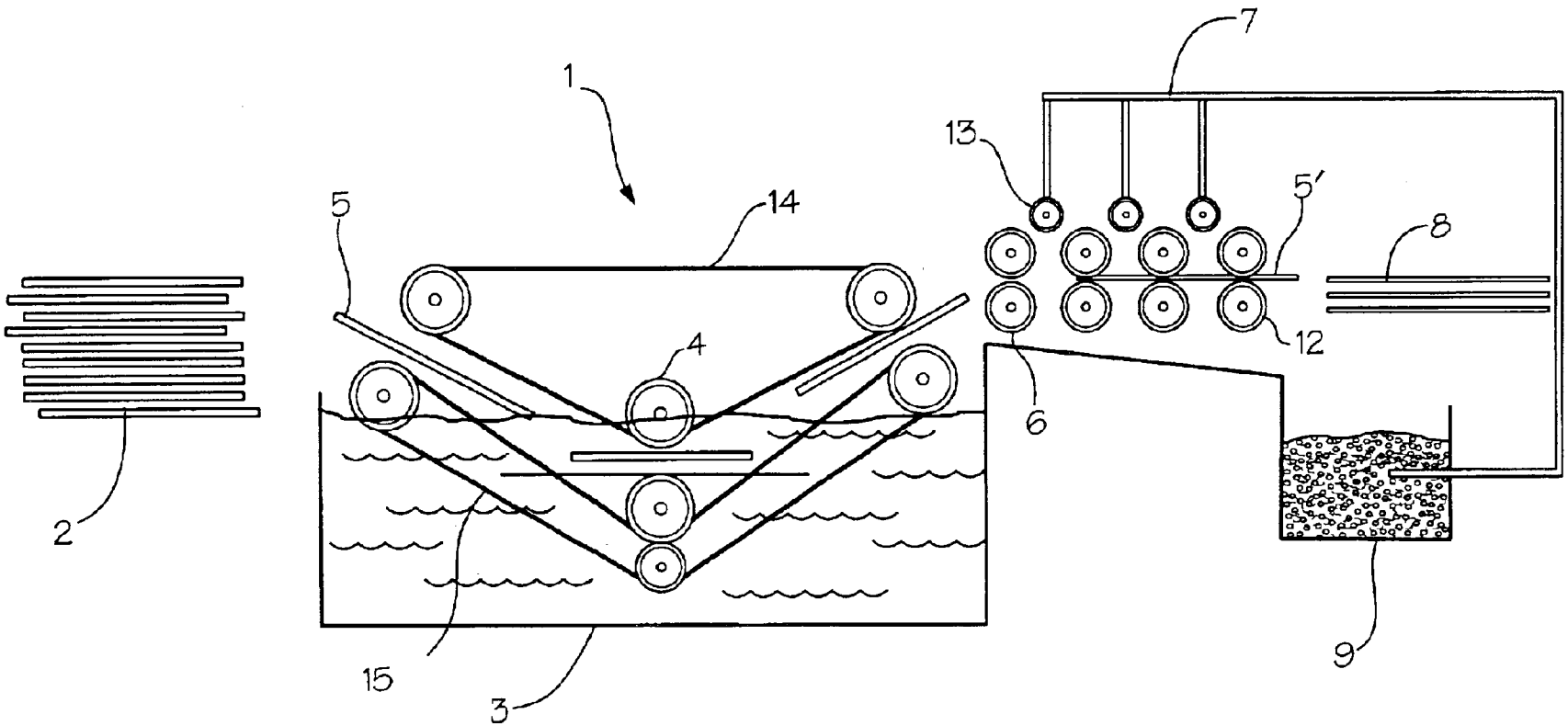
FIG. 1 is schematic representation of a process for coating and moisture proofing paperboard according to one embodiment of the invention.

As used herein the following terms are understood to have the meanings as set forth:

"Triglyceride" includes both animal fats and vegetable oils and is derived from one or both of them.

"Paraffin" is a wax-like product derived from petroleum.

"Paper" includes substrates and surfaces of cellulosic material.

DETAILED DESCRIPTION

It has been found that hydrogenated vegetable oil triglycerides and lard or tallow triglycerides prepared according to the inventor can be substituted for petroleum based paraffin waxes and wax compounds in substantially every application in the paper industry. All of these application systems involve melted product held at temperatures in the range from around 125° to 170° F. which is either squeezed, rolled, cascaded, sprayed, or doctored onto the linerboard, paper, carton stock, or corrugated medium surface, after which the coating is cooled or set. In tests thus far the following application/applicator have been identified:

1. Wax cascaders: Paraffin waxes and wax based compounds are traditionally applied to semi-formed boxes that are placed on conveyor mounted wire frames and conveyed under a waterfall or cascade of hot molten product, after which the boxes continue through a cooling tunnel supplied with refrigerated air as a means of solidifying the coating. The present invention replaces these petroleum wax products on a 1:1 basis, and thus makes the boxes compostable and biodegradable.

2. Wax curtain coaters: Paraffin waxes and wax based compounds are traditionally applied to semi-formed boxes on a die cutting machine that first cuts the form for the box from a corrugated sheet, folds it into a collapsed flat form, and then places it on a conveyor which carries the box under a curtain of hot molten product that issues from a side-to-side slit at the end of the melted product delivery pipe, after which the boxes may continue through a cooling tunnel supplied with refrigerated air as a means of solidifying the coating, and may or may not be flipped or inverted to expose the uncoated side to a second curtain coater or to feed it through the original curtain coater on a second pass. The present invention replaces these wax products on a 1:1 basis, and thus make the boxes compostable and biodegradable.

3. Wax impregnators: Linerboard or folding carton sheet is fed from a roll that may be mounted at the rear of a corrugating machine and then travels forward through a bath of hot melted product which is normally equipped with opposing squeezing or dressing rolls that force the melted product into the linerboard sheet and remove the excess, which falls back into the bath. If a linerboard sheet is impregnated, it then moves forward on the corrugator and may be incorporated in corrugated board as one of the three or more sheets that form standard corrugated board. In some instances the impregnated linerboard may be used as one of the outside liners or it may be used as the fluted medium sheet sandwiched in the middle of the corrugated sheet, and in other instances, two or more impregnators may be employed to apply melted product to two or several of the linerboard sheets that compose the corrugated board. If folding carton stock is impregnated, it can be used as is for the packaging material.

4. Wax spray coaters: Paraffin waxes and wax based compounds are traditionally applied to semi-formed boxes on a die cutting machine that first cuts the form for the box from a corrugated sheet, folds it into a collapsed flat form, and then places it on a conveyor which carries the box under one or a bank of several spray heads that are heated to temperatures sufficient to assure that the molten product remains fluid until it has contacted and semi-penetrated the box linerboard substrate, after which the boxes continue through a cooling tunnel supplied with refrigerated air as a means of solidifying the coating, and may or may not be flipped or inverted to present the uncoated side to a second spray coater or to feed it through the original spray coater on a second pass. FIG. 1 shows a similar process. The present invention replaces these wax products on a 1:1 basis, and thus make the boxes compostable and biodegradable.

The coating or treating compositions of the invention can be made from any vegetable or animal oil suitable for hydrogenation; however, the intended application will control the starting raw materials and the finished compound formulation in each case. Sources of such oils or fats include beef tallow, pork lard, poultry greases, fish oils, and the oils of coconut, palm, castor, olive, cottonseed, linseed, peanuts, soy, and corn, palm kernel, rape seed and canola. The selection variables are directed by desired properties, regulations, and cost (among others). Examples include the use of virgin vegetable oils only in coating linerboard, corrugated sheet, or folding carton stock if it is to be used to package Kosher foods; or, only materials that have been produced and maintained by specific means and standards that are in conformity with the regulations of the Food & Drug Administration and that can be used for packaging for wet food contact; and, only materials that can yield high temperature melting points that can be used on boxes that are to be packed in tropical areas.

The basic raw materials can be from virgin vegetable sources or they can be the same oils after use in food preparation processes such as fryers and then appropriately reclaimed for use in the present invention. They can originate from poultry factories that prepare chicken for fast food restaurants by precooking them and gathering the residual fats for use in the process of this invention.

A preferred vegetable product is hydrogenated soybean oil triglycerides, and even though more expensive than alternatives, it finds uses in many applications. Soybean oil's unique properties permit its use in all currently tested applications. These range from folding carton fish boxes, to poultry plant bin boxes, to asphalt release form papers, with many varied applications in between. In addition, these hydrogenated triglycerides generally have a higher flash point than paraffin.

The properties of the preferred soybean oil triglyceride can be varied by the process of hydrogenation, that is, a wide range of melting and hardening properties can be achieved that are similar to those of petroleum waxes. The pertinent properties of three of the preferred hydrogenated soybean oil triglycerides, A, B, and C are set forth in Table I below:

TABLE I

| Product: | A | B | C |
|---|---|---|---|
| Appearance | Waxy | Waxy | Waxy |
| Solids | 100% | 100% | 100% |
| Melting Point | 60–65° C. | 58–64° C. | 56–60° C. |
| Moisture, % | 0.2, max | 0.2, max | 0.2, max |
| Iodine Value, $CgI_2/g$ | 2, max | 8–12 | 18–22 |
| Acid Value, Mg KOH/g | 2, max | 2, max | 2, max |
| Saponification #, Mg KOH/g | 195–205 | 195–205 | 195–205 |

The above hydrogenated products are from edible grade oil that can be certified as Kosher and are totally biodegradable and digestible.

Referring now to FIG. 1, a schematic representation of a typical and preferred commercial production line 1 is shown wherein a sheet of corrugated paperboard 5' is fed from a stack of corrugated paperboard in sheet feeder 8 through feed rollers 12 under applicator sprayers 13 that are fed by lines 7 carrying hot melt hydrogenated triglyceride from melt tank 9. The coated boards then travel between conveyor belts 14 and 15 into cooling water bath 3 where the rollers 4 keep the sheets 5 submerged so that the coating will harden. The sheets 5 are then stacked in stack 2. Rather than being single layer sheets the stack 8 of sheets 5' can be flattened box preforms and the spray can then cover the entire exterior surface of the box-to-be-formed by adding additional sprayers 13 to coat the boxes from the bottom side.

To compare the coatings according to the invention with standard paraffin (petroleum) coatings, samples resulting from the application as in FIG. 1 of paraffin waxes and a similar coating of hydrogenated triglyceride to carton stock paperboard were cut into two inch strips and partially submerged in ambient temperature water to test wicking properties. The total test duration extended to five days, with burst tests performed at three days. The water wicking and residual strength of the tested samples were then tested. The results are shown as follows in Table II.

TABLE II

| | Water pick up | | | | |
|---|---|---|---|---|---|
| Coating | $g/in^2$ | % of fiber weight | Tensile kgs. | Burst* $lbs/in^2$ | Wicking mm/3.7 hrs |
| Paraffin wax | 0.90 | 126.5 | 12.37 | 39.3 | 50 |
| Triglyceride | 0.56 | 80.2 | 25.28 | 78.3 | 15 |

*Burst is tested with 3 days wicked board

Figure 2:
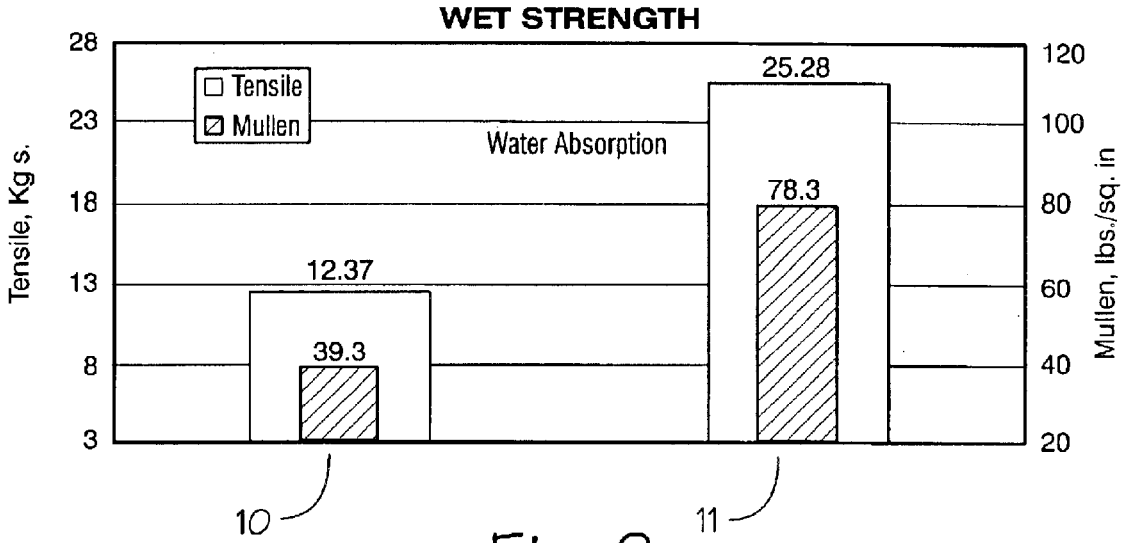
FIG. 2 is a bar graph comparing the wet strength of paraffin wax coated paperboard and paperboard treated according to an embodiment of the invention.

The wet strength differences are shown graphically in FIG. 2 where the paraffin wax coated paperboard is represented by bar 10 and the hydrogenated triglyceride of the invention is represented by bar 11.

The hydrogenated triglyceride consistently delivers greater water resistance than paraffin wax which microscopic examination suggests is due to higher fiber penetration. This overall superior water resistance of the hydrogenated triglyceride then contributes to the maintenance of higher comparative three-day wet strength in the coated board samples.

Figure 3:
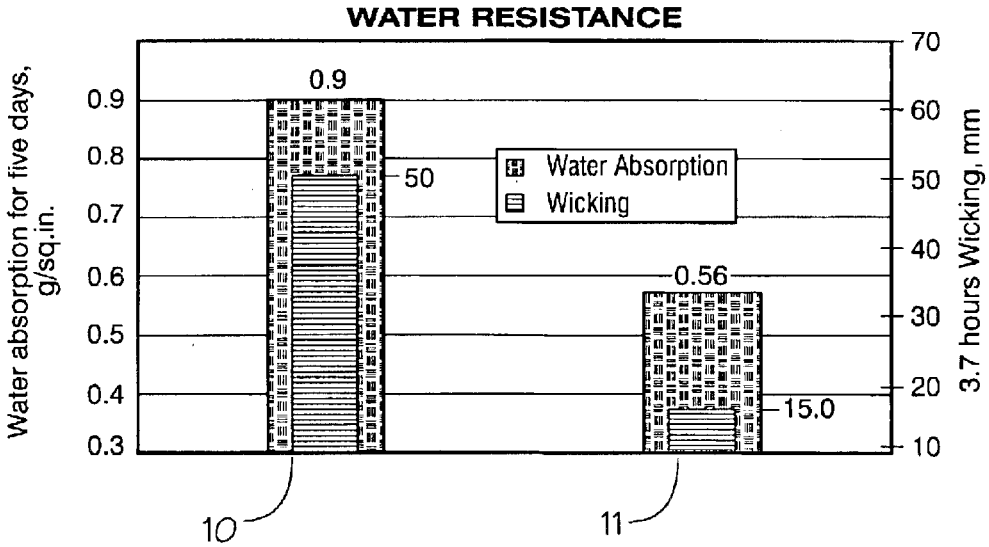
FIG. 3 is a comparison of the water resistance of paperboard coated with paraffin wax with paperboard treated according to a process of an embodiment of the present invention.

The water resistance is graphically shown in FIG. 3 where the paraffin is represented by bar 10 and the hydrogenated triglyceride is represented by bar 11. The wicking and absorption by the triglyceride coating is clearly lower. The foregoing demonstrates the moisture resistance superiority of paper products coated with hydrogenated triglyceride.

The use and concentration of the hydrogenated triglyceride coatings varies with the end-use application and the process machinery. Typically coatings on paperboard may range from 2 to 12 pounds (lbs.) per thousand square feet (mft). Preferably this would be in the range of 3 to 9 lbs/mft. These are not limiting ranges but exemplary ranges.

One preferred coating concentration is about 4 lbs/mft. In general the coating weights are less than those required by paraffin.

Turning now to the repulping and recycling aspects, the method and machinery or equipment for repulping and recycling scrap paper in the paper and paperboard or liner board industry is both an established and well known art, and the equipment required is standard and commonly installed at most mills incorporating recycled paper in their manufacturing feed stocks. Thus, those skilled in the paper making art are also knowledgeable in re-pulping and recycling.

Water repellent packaging that utilizes petroleum based liquid polymers or polymer film laminates (including polyethylene or similar film laminates such as polyolefin, polyester, polyvinyl alcohol, polyvinyl acetate, polystyrene, polypropylene, and the like) have been proven to be recyclable; however, all require the installation of specialized repulping machinery that separates the pulp fibers from the laminated films and/or is far more expensive in terms of operating costs and/or recycled pulp fiber yields. The action of separating the fiber from the film damages some fibers causing them to be selected out of the recycled pulp and/or presented for reuse, and the separated waste film carries some of the fibers out of the repulpate when its adherence is not interrupted by the repulping process. Likewise, coatings and impregnating products made from or based on paraffin waxes and/or similar petroleum derivatives can be repulped for recycling in specially configured repulping equipment that removes and separates the paraffin waxes; however, as in the laminated film repulping process, the more intense physical and chemical requirements of this repulping process coupled with the lost fibers that become trapped in paraffin wax wastes cause the recyclable repulped fiber levels to fall far below those of standard repulping processes.

By contrast, repulping rates for hydrogenated triglyceride treated paper and paperboard or linerboard appear to be equal to those of untreated paper and paperboard or linerboard, and the time, energy, chemical, and other invested resources are no greater.

To demonstrate that triglyceride-coated paperboard is readily repulpable the following test was conducted in which the following samples were prepared:

1. Standard paraffin wax coating

2. Hydrogenated Triglyceride coating (EvCopel™ HSBTG coating from EvCo Research, LLC, Atlanta, Ga.)

Both samples were coated at a carton coating facility using standard application equipment, which featured a hot wax spray followed by felted dress rolls to level the applied coating similar to the process in FIG. 1 so that both samples received essentially the same respective level of coating. Sample 1 was coated with a standard carton-coating grade paraffin wax and Sample 2 with the hydrogenated soybean oil triglyceride.

The repulping test procedure was as follows:

The repulper was pre-set with a recirculating water temperature of 60° C. and 6.9 pH.

The sample sheets were cut into measured squares and placed directly into the repulper.

The disintegrator shear rate setting is 15,000 revolutions for 4:30 minutes.

The vibrating slotted screen filter was then fitted with a mesh of 0.15 mm screen.

The resulting pulp sample from the disintegrator was then filtered 30+ minutes.

The recovered and rejected pulp fiber samples were then dried in the evaporative oven.

The samples were then weighed to calculate the repulped fiber recovery ratios.

The two coated carton board samples were individually repulped using the above procedure and the reclaimed pulp fibers were cast into test sheets. Both the raw pulp stock and the hand sheets were then observed microscopically and compared in standard lab tests.

The principal differences observed between the two samples of reclaimed raw stock fiber and corresponding test sheets were in the flakes of flocculated coating deposited on the stock and then carried to the test sheet surfaces. The presence of flakes and the flake size were noticeably higher in Sample 1 than in Sample 2. This difference appears to be attributable to the greater dispersibility of the triglyceride by comparison to paraffin wax materials.

Though traditional paper repulping processes are carried out at alkali pH levels, no attempt was made to saponify the triglyceride during this evaluation process. Nevertheless, the repulping trials were conducted in a typical alkali environment to emulate standard mill procedures and conditions. In this evaluation, the test sheet samples were repulped at three different pH levels: 7.0, 8.9, and 10. No foam or very low, unstable foam was apparent regardless of the repulping slurry pH level with any of the test sheet samples.

The test sheets made from the repulped stock were observed to be similar in appearance and physical properties; however, because of the presence of the larger agglomerated flakes of paraffin waxes in the standard sample, there were a number of dark spots on the paper samples made from Sample 1 making it less desirable and acceptable than Sample 2.

In conclusion, it has been found that boards coated with the hydrogenated triglyceride of the invention can be repulped at normal repulping conditions. The triglyceride coatings are easily removed with normal foam tank separation processes. The triglyceride particles formed during repulping float on the cool water and are not attracted to the paper fiber.

In reading the above detailed description and examples, the principles and best modes of this invention will be understood by those skilled in the art. However, other embodiments and equivalents of the invention that may be derived from the above are understood to be within the scope of the invention which is limited only by the claims that follow:

I claim:

1. A repulpable moisture resistant paper product comprising:

a) a paper product having a surface;

b) a coating on said surface, said coating consisting essentially of a hydrogenated triglyceride or a blend of natural, partially and fully hydrogentated triglycerides said coating having a minimum melting point of at least about 50° C.;

c) said coating imparting improved moisture resistance and wet strength to said paper product; and d) said coated paper product being repulpable and recyclable.

2. The repulpable moisture resistant paper product wherein the melting point of the hydrogenated triglyceride is in the range from about 55° C. to about 65° C.

3. The repulpable paper product of claim 2 wherein the hydrogenated triglyceride is hydrogenated vegetable oil selected from the group consisting of soybean oil, peanut oil, olive oil, palm, coconut and cottonseed oils.

4. The repulpable paper product of claim 2 wherein the triglyceride is selected from the group consisting of beef tallow, pork lard, poultry grease, and fish oils.

5. The recycled paper product of claim 2 wherein the triglyceride is a reclaimed triglyceride.

6. The paper product of claim 1 wherein said hydrogenated triglycerides have carbon chain lengths between C:14 and C:20, an amorphic crystalline structures, and a melt temperature from about 55° C. to about 65° C.

7. The paper product of claim 1 wherein the paper substrate is corrugated paperboard and the coating of hydrogenated triglyceride has been applied as a hot melt and ranges from about 2 lbs. to about 12 lbs. per thousand square feet of paperboard surface, said triglyceride coating having impregnated the surface of the paperboard.

8. The paper product of claim 7 wherein the corrugated paperboard is a flattened box perform.

9. The paper product of claim 3 wherein the paper product is a moisture proof carton for a food product.

* * * * *

US006846573C1

(12) EX PARTE REEXAMINATION CERTIFICATE (10125th)

United States Patent

Seydel

(10) Number: US 6,846,573 C1

(45) Certificate Issued: Apr. 21, 2014

(54) MOISTURE RESISTANT, REPULPABLE PAPER PRODUCTS AND METHOD OF MAKING SAME

(75) Inventor: Scott O. Seydel, Atlanta, GA (US)

(73) Assignee: AKZO Nobel Chemicals Inc., Chicago, IL (US)

Reexamination Request:
No. 90/012,491, Sep. 12, 2012

Reexamination Certificate for:

| | |
|---|---|
| Patent No.: | **6,846,573** |
| Issued: | **Jan. 25, 2005** |
| Appl. No.: | **10/409,238** |
| Filed: | **Apr. 8, 2003** |

Related U.S. Application Data

(60) Provisional application No. 60/373,952, filed on Apr. 19, 2002.

(51) Int. Cl.

| | |
|---|---|
| ***D21H 21/20*** | (2006.01) |
| ***D21H 21/14*** | (2006.01) |
| ***D21H 19/00*** | (2006.01) |
| ***D21H 19/14*** | (2006.01) |

(52) U.S. Cl.
CPC ..... *D21H 21/20* (2013.01); *D21H 19/14* (2013.01)
USPC ..... 428/537.5; 428/34.2; 428/536

(58) Field of Classification Search
None
See application file for complete search history.

(56) References Cited

To view the complete listing of prior art documents cited during the proceeding for Reexamination Control Number 90/012,491, please refer to the USPTO's public Patent Application Information Retrieval (PAIR) system under the Display References tab.

*Primary Examiner* — Elizabeth McKane

(57) ABSTRACT

Hydrogenated triglycerides having melting points above 50° C. are substituted for paraffin as a coating material for the surface of paper products and the resulting paper products have improved wet strength and moisture resistance in addition to being repulpable thereby providing a distinct environmental advantage over paraffin coated products.

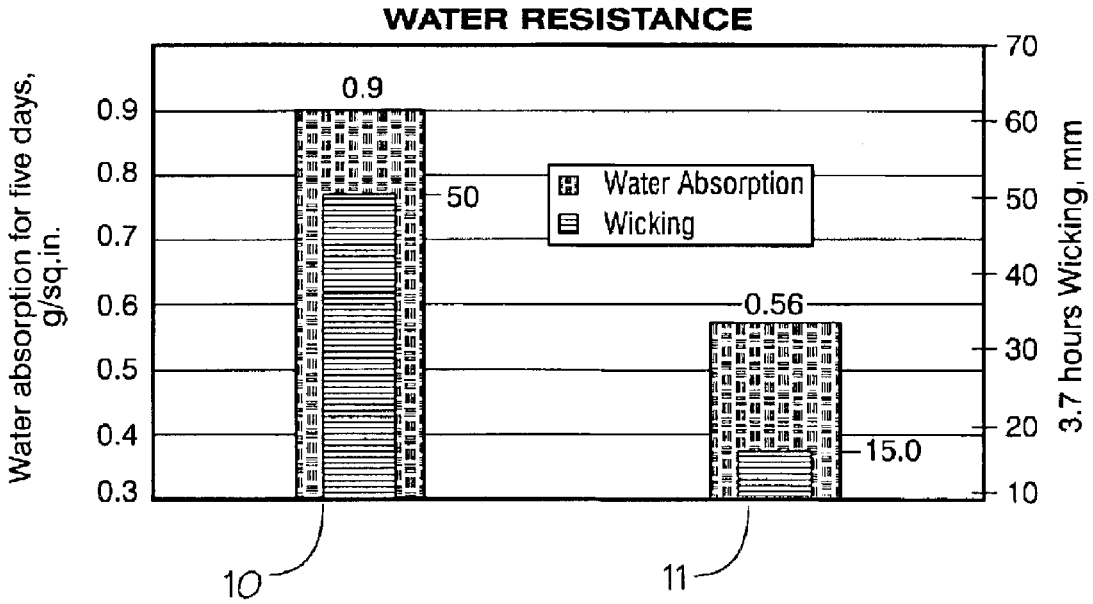

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-9 are determined to be patentable as amended.

1. A repulpable moisture resistant paper product comprising:

a) a paper product having a surface;

b) a *triglyceride-based* coating on said surface, said *triglyceride-based* coating consisting essentially of a hydrogenated triglyceride or a blend of natural, partially and fully [hydrogentated] *hydrogenated* triglycerides, said *triglyceride-based* coating having a minimum melting point of at least about 50° C.;

c) said *triglyceride-based* coating imparting improved moisture resistance and wet strength to said paper product, *as compared to the same paper product coated with essentially the same respective level of paraffin wax coating to form a paraffin-coated paper product,*

*wherein both said triglyceride-based coating and said paraffin coating are coated at about 125-170° F. with a coating thickness of 2-12 lbs/mft;*

*wherein both said triglyceride-based coating and said paraffin coating are sprayed onto said paper product as a hot melt followed by submerging the coated paper product in a water bath; and*

*wherein the paraffin coating, when applied to carton stock paperboard provides a paper product exhibiting, after being cut into a two inch strip then partially submerged in ambient temperature water for five days, a water pick up of 0.90 g/in$^2$, a water pick up of 126.5% of fiber weight, and a tensile strength of 12.37 kgs; a burst strength of 39.3 lbs/in$^2$ after three days; and wicking of 50 mm/3.7 hours;* and d) said coated paper product being repulpable and recyclable,

*wherein the moisture resistance is determined by the height of water wicking in the coated paper product when partially submerged in water at room temperature for five days.*

2. The repulpable moisture resistant paper product *of claim 1*, wherein the melting point of the hydrogenated triglyceride is in the range from about 55° C. to about 65° C.

3. The repulpable *moisture resistant* paper product of claim 2 wherein the hydrogenated triglyceride is hydrogenated vegetable oil selected from the group consisting of soybean oil, peanut oil, olive oil, palm, coconut and cottonseed oils.

4. The repulpable *moisture resistant* paper product of claim 2 wherein the triglyceride is selected from the group consisting of beef tallow, pork lard, poultry grease, and fish oils.

5. The [recycled] *repulpable moisture resistant* paper product of claim 2 wherein the triglyceride is a reclaimed triglyceride.

6. The *repulpable moisture resistant* paper product of claim 1 wherein said hydrogenated triglycerides have carbon chain lengths between C:14 and C:20, an amorphic crystalline structures, and a melt temperature from about 55° C. to about 65° C.

7. The *repulpable moisture resistant* paper product of claim 1 wherein the paper substrate is corrugated paperboard and the coating of hydrogenated triglyceride has been applied as a hot melt and ranges from about 2 lbs. to about 12 lbs. per thousand square feet of paperboard surface, said triglyceride coating having impregnated the surface of the paperboard.

8. The *repulpable moisture resistant* paper product of claim 7 wherein the corrugated paperboard is a flattened box perform.

9. The *repulpable moisture resistant* paper product of claim 3 wherein the paper product is a moisture proof carton for a food product.

* * * * *